US005362440A

United States Patent [19]

Madan et al.

[11] Patent Number: 5,362,440

[45] Date of Patent: Nov. 8, 1994

[54] FERROPHOSPHORUS REFINING PROCESS

[75] Inventors: Deepak Madan, Mars; Young Lee, Pittsburgh; Alan FitzGibbon, Wexford; Roland Gamroth, Bradfordwoods, all of Pa.

[73] Assignee: Elkem Metals Company, Pittsburgh, Pa.

[21] Appl. No.: 31,679

[22] Filed: Mar. 15, 1993

[51] Int. Cl.[5] ..... C22C 33/04

[52] U.S. Cl. ..... 420/88

[58] Field of Search ..... 420/88; 423/299, 322

[56] References Cited

U.S. PATENT DOCUMENTS

| | | | |
|---|---|---|---|
| 3,154,410 | 10/1964 | Darrow et al. | 420/88 |
| 3,305,355 | 2/1967 | Darrow et al. | 420/88 |
| 3,460,937 | 8/1969 | Rathmann | 423/607 |
| 3,744,999 | 7/1973 | Scott | 420/88 |
| 3,998,631 | 12/1976 | Hansen | 420/88 |
| 4,201,576 | 5/1980 | Haley | 75/132 |

OTHER PUBLICATIONS

Metal Powder Report, Jan. 1993, "Avoiding Brittleness in Iron-Phosphorus Alloys" pp. 36-39.

*Primary Examiner*—Peter D. Rosenberg

*Attorney, Agent, or Firm*—Lucas & Just

[57] ABSTRACT

The ferrophosphorus refining method entails forming a ferrophosphorus melt and adding an oxidizing agent to the melt to oxidize the impurities in the melt. The oxidized impurities then rise to the top of the melt and either go into the slag or escape in a gaseous forte. The slag is removed and a refined ferrophosphorus is recovered. Suitable oxidizing agents include solids such as ferrous oxide ($Fe_2O_3$), ferric oxide ($Fe_3O_4$), ferrous-ferric oxide (FeO), mill scale, limestone, dolomitic limestone, lime and any alkalide carbonate; and gaseous oxidizing agents such as oxygen, air and mixtures thereof.

20 Claims, No Drawings

FERROPHOSPHORUS REFINING PROCESS

This invention relates to a method for refining a metallurgical grade phosphorus-rich ferrous alloy to remove impurities in an effective and economic manner. The phosphorus-rich ferrous alloy refined by the process of the present invention is especially suited for use in particulate processing technologies.

Phosphorus additions are used to improve the mechanical properties of certain grades of steel. In particulate processing technology, phosphorus additions are used to improve the mechanical properties for certain structural components and to enhance the magnetic properties for certain soft-magnetic components. Phosphorus can be added either as a particulate elemental phosphorus or as a phosphorous alloy. Use of particulate elemental phosphorus presents both processing difficulties and safety hazards. Thus, the use of a phosphorous alloy is the preferred mode for adding phosphorus. A metallurgical grade phosphorus-iron alloy (or ferrophosphorus) is available as a by-product from the production of elementary phosphorus and typically contains about 15 to 30 weight percent phosphorus and a remainder of iron with a high level of impurities. As an example, metallurgical grade ferrophosphorus may contain around 3 weight percent silicon and around 2 weight percent manganese. It has been found that such a high level of impurities is detrimental to both the mechanical and magnetic properties of the particulate metal product to which it is added. Use of ferrophosphorus with low impurity levels, for example silicon below about 0.5 weight percent, manganese below about 0.5 weight percent, oxygen below about 0.75 weight percent, and carbon below about 0.5 weight percent, results in a favorable combination of mechanical and magnetic properties for components made by particulate processing technology.

Conventionally, the impurity level of metallurgical grade ferrophosphorus is controlled by controlling the charge to the furnace and the recovery of the ferrophosphorus from the furnace during production of elemental phosphorus. One way to produce ferrophosphorus with low impurities is to melt high purity iron and phosphorus in a reaction vessel. However, such would require special handling of the phosphorus and would not be cost effective. U.S. Pat. No. 4,201,576 issued May 6, 1980 discloses a method for removing silicon from ferrophosphorus. In the '576 patent, the silicon in an unrefined ferrophosphorus is changed to silica (silicon dioxide) by treating the unrefined ferrophosphorus with an aqueous oxidizing agent and then drying the silica-containing ferrophosphorus at a temperature above 900° F. The dried ferrophosphorus is incorporated into iron or steel by adding it to a molten bath of iron or steel. Since silica is not soluble in molten iron or steel, the silica impurity will allegedly allow for incorporation of the ferrophosphorus into molten iron or steel without the silicon. Obviously, such a process is not acceptable where the ferrophosphorus is incorporated into a solid iron or steel, such as in powder metal applications (particulate processing technologies).

A method for refining ferrophosphorus has now been discovered which produces a ferrophosphorus substantially free of impurities. Broadly, the method of the present invention comprises treating a molten mass of unrefined metallurgical grade ferrophosphorus with an oxidizing agent at a temperature above the melting point of the alloy to oxidize impurities in the ferrophosphorus such that a slag is formed on top of said molten mass and oxidized impurities in said unrefined ferrophosphorus migrate to said slag and then removing an impurity rich slag from the top of the melt. The resulting molten ferrophosphorus is substantially free of impurities and can then be further processed, such as by solidification and grinding, to the desired size for the desired application, for example, use in particulate processing applications.

Typically, unrefined metallurgical ferrophosphorus comprises about 15 to about 30 weight percent phosphorus; about 80 to about 65 weight percent iron; and a remainder of impurities. The impurities removed by the present invention are impurities that are easily oxidizable in the metallurgical grade ferrophosphorus. Such impurities include silicon, manganese, chromium, carbon, titanium, aluminum and calcium. It should be noted that, in certain situations, carbon may be a desirable component in the ferrophosphorus. In such a situation, the present invention provides a means to control the amount of carbon present in the ferrophosphorus by means of reducing the amount and then allowing for the addition of carbon to the ferrophosphorus.

The treatment of the molten mass with an oxidizing agent is accomplished by the addition to and mixing of the oxidizing agent with the molten unrefined ferrophosphorus. The oxidizing agent causes a majority of the impurities in the ferrophosphorus to be oxidized. The oxidized impurities escape as a gas or go into the slag which collects at the top of the melt. The impurities in the slag are subsequently removed from the melt by removing the slag from the top of the melt.

Suitable oxidizing agents for use in accordance with the present invention include solid particulate oxidizing agents, gaseous oxidizing agents and a combination thereof.

Suitable particulate oxidizing agents include iron oxides such as ferric oxide ($Fe_2O_3$) and ferrous-ferric oxide ($Fe_3O_4$). Mill scale, the black scale of magnetic oxide of iron that forms on iron and steel when heated for rolling, forging or other processing, is also a suitable source of iron oxide. Other suitable solid particulate oxidizing agents for use in accordance with the present invention include carbonates of alkali metal or an alkaline earth metal, such as limestone (calcium carbonate), and dolomitic limestone, a limestone that contains more than about 5% magnesium carbonate. The effectiveness of the solid oxidizing agent is related to its ability to generate oxygen in the melt. The better its ability to generate oxygen, the better the oxidizing agent. The preferred solid particulate oxidizing agents are ferrous oxide, ferric oxide, ferrous-ferric oxide, mill scale, limestone, and dolomitic limestone. Good results have been obtained with ferric oxide and mill scale.

Suitable gaseous oxidizing agents are oxygen, air, carbon dioxide, or a mixture or a combination of either of these gases, with or without an inert gas. Suitable inert gases include argon, nitrogen and helium. Good results have been obtained with the use of oxygen.

A combination of the solid and gaseous oxidizing agents can be used in accordance with the present invention. For example, ferric oxide can be used in combination with oxygen.

In order to determine how much of an oxidizing agent to add to treat the ferrophosphorus, the level of oxidizable impurities in the metallurgical grade ferrophosphorus, the available effective-oxygen content of the oxidizing agent, and the desired aimed chemistry must be determined. Any conventional method can be employed to determine the level of oxidizable impurities in the starting ferrophosphorus and the effective-oxygen content of the oxidizing agent. The amount of oxidizing agent or agents to be added to oxidize the impurities to within the desired range is calculated in a conventional stoichiometric manner. Preferably, an excess of the oxidizing agent or agents is used to compensate for inefficiencies in the process. More preferably, the oxidizing agent or agents are used in an amount up to about 200% of a calculated stoichiometric amount. A greater amount of oxidizing agents may be used if necessary. Where a combination of oxidizing agents is used, the total amount is preferably in excess of the stoichiometrically calculated amount and, more preferably, up to about 200% in excess of the stoichiometrically calculated amount.

The calculation for the amount of oxidizing agent to be added is made in a conventional manner. As an example, assume that it is desired to decrease the silicon content by I weight percent and that all the silicon was present in solution. A 1000-gram melt of the raw material would contain 10 grams of silicon that needs to be oxidized. The silicon in the melt will oxidize via the following reaction:

$$Si+O_2 \rightarrow SiO_2 \quad (1)$$

A material balance, based on reaction (1), dictates that 1.14 grams of oxygen are needed to oxidize every gram of silicon. Thus 11.4 grams of oxygen are needed to remove the 10 grams of silicon in the melt. Iron oxide can be used as an oxidizing agent to remove the silicon. The oxygen is yielded by the following reaction:

$$2Fe_2O_3 \rightarrow 4FeO+O_2 \quad (2)$$

A material balance, based on reaction (2), dictates that 10 grams of iron oxide are required to provide i gram of oxygen available for the reaction. Thus, based on a material balance, to have 11.4 grams of oxygen available for reaction (1), theoretically, 114 grams of iron oxide should be added. However, due to inefficiencies of the reaction, the actual amount of oxidizing agent added is calculated based on empirical relationships and is in excess of the amount calculated based on the material balance. Typically, the actual amount added is up to about 200% of the amount calculated by the material balance. Thus, in this example the actual amount of iron oxide added would be 171 grams (150%).

After addition of the oxidizing agent, the oxidation reaction is allowed to proceed for a period of time sufficient to obtain oxidation of the impurities in the melt. Good results have been obtained in about 10 to about 20 minutes after the addition of the oxidizing agent.

The oxidation reaction is preferably accompanied by mixing so as to obtain a uniform molten mixture and uniform treatment while the alloy is in a fluid state. The temperature of the melt has to be sufficiently high to maintain a fluid alloy. This temperature should be above the melting point of the alloy and, preferably, about 100° C. above the melting point of the alloy. More preferably, the temperature of the melt is about 100 to about 200° C. above the melting point of the alloy. Typically, unrefined ferrophosphorus will melt at a temperature of about 1100° C. to about 1300° C. Good results in accordance with the present invention have been obtained using a temperature of about 1400° C. and above.

The oxidation reaction causes the majority of the impurities in the ferrophosphorus to form oxides. These oxides are insoluble in the molten ferrophosphorus and are less dense than the molten ferrophosphorus. This means that the oxidized impurities either float to the top of the melt and enter the slag or escape in a gaseous form. The slag is then removed from the top of the melt.

The overall phosphorus content of the molten ferrophosphorus can be adjusted by the addition of an iron source to the ferrophosphorus either before or after treatment with an oxidizing agent. Preferably, the phosphorus content is adjusted before the treatment step with the oxidizing agent. Good results have been obtained by the co-melting of an iron source and an unrefined, solid ferrophosphorus. Preferably, the iron source has a low level of impurities. Suitable iron sources include iron scrap or steel scrap, both with low levels of impurities, and pure iron pieces.

When iron oxide is used as the oxidizing agent, some of the iron from the oxidation reaction can dilute the alloy; however, an additional source of iron may be required to adjust the phosphorus content of the alloy to the desired level.

In order to know how much of an iron source to add to the ferrophosphorus, the phosphorus content of the unrefined, metallurgical grade ferrophosphorus must be determined prior to addition of the iron source. Any conventional method can be employed to determine the phosphorus content of the ferrophosphorus. The amount of iron source to add to adjust the phosphorus content to within the desired range is calculated in a conventional manner, after adjusting for phosphorus loss due to oxidation.

In order to flux the oxide impurities in the slag, a flux agent or agents can be added to the melt. Suitable flux agents used in accordance with the present invention include oxides and/or halides of alkali metals and alkaline earth metals and carbonates of alkali metals and alkaline earth metals. Lime, limestone, dolomitic limestone, dolomite and calcium fluoride are useful in the present invention. Good results have been obtained with lime and dolomitic limestone. It will be appreciated by those of skill in the art that certain oxidizing agents also work as flux agents in the present invention.

Forming the melt of ferrophosphorus, adding the oxidizing agent to the melt and mixing the melt oxidizing agent into the melt are accomplished in a conventional manner using conventional equipment. In order to form the melt of unrefined ferrophosphorus, molten ferrophosphorus as tapped from the furnace used to produce elemental phosphorus can be treated in accordance with the present invention. Conventionally, elementary phosphorus is produced in a furnace by melting a mixture of phosphate rock (ore), silica, coke and coal. The elemental phosphorus is given off as a vapor while slag is removed from an upper tap hole in the furnace and molten, unrefined ferrophosphorus is removed from a lower tap hole in the furnace. Alternatively, solidified, unrefined ferrophosphorus recovered from the furnace can be melted (remelted) and then subjected to the treatment in accordance with the present invention. The addition of the oxidizing agent to the melt is accomplished in a conventional manner, such as gravity feed or injection. Once the melt is formed, a mixing means is employed to mix the oxidizing agent into the melt and obtain uniform refining of the melt.

Good results have been obtained by melting solidified, unrefined ferrophosphorus in a clay-graphite crucible with an induction furnace wherein the stirring action is due to the induction heating process. Suitable heating devices for use in accordance with the present invention include gas-fired furnaces, electric-arc furnaces, and resistance heating furnaces. Suitable mixing means for use in accordance with the present invention include mechanical stirring, such as an impeller, gas-assisted stirring, such as porous plug and gas injection, and induction stirring. The container in which the ferrophosphorus is treated must be suitable for this operation. Suitable containers include magnesite (MgO) crucibles, alumina crucibles, graphite crucibles, clay-graphite crucibles or containers lined with magnesite (MgO), alumina, graphite and clay-graphite.

Removing the slag from the top of the molten ferrophosphorus in accordance with the present invention is done in a conventional manner using conventional equipment. The slag removal technique should be compatible with the furnace. Good results have been obtained by decanting the slag from the alloy, skimming the slag off the alloy, and bottom tapping of the molten alloy.

After removal of slag, a deoxidizing agent with stronger affinity for oxygen than silicon can be added to the molten alloy to remove any dissolved oxygen if necessary. Suitable deoxidizing agents for use in the present invention include aluminum. The aluminum is added in an amount sufficiently small enough so as not to add aluminum to the melt but merely to act as a deoxidizer in the melt.

After removal of the slag and any deoxidization, the molten mass is solidified into a desired form in conventional manner using conventional equipment. Suitable techniques include casting into ingots or any shape, granulation, atomization, net-shape casting and shotting. Good results have been obtained by casting into tall ingots to insure complete slag-metal separation.

After solidifying, the solid ferrophosphorus can be further processed in any conventional manner using conventional equipment to obtain the desired size. Preferably, any further processing is done in a manner to minimize introduction of impurities into the refined ferrophosphorus. In the case of an ingot, it is preferably subjected to a crushing and milling operation to produce a particulate ferrophosphorus. Such operation can be done to reduce the ferrophosphorus to a size from 4 inches down to 10 microns. Suitable crushing and milling operations are achieved by using any appropriate equipment or a combination of equipment. Equipment used to reduce the size of the alloy includes jaw-crushers, cone-crushers, hammer-mills, impact mills, fluidized-bed mills, vibrating ball mills, vibratory mills, ball mills, rod mills, attrition mills, high-energy mills, cold-stream impact mills, or shear mills. The mill used can be equipped with a closed-loop classification system for effective size control. If the mill is not equipped with a closed-loop classifier, it may be necessary to incorporate an independent classification step. Preferably, the product has a short residence time in the mill. The final milling is preferably done in a closed-looped mill, such as a fluidized-bed mill, using an in situ classifier to control the particle size. The milling is preferably done in an inert atmosphere.

These and other aspects of the present invention may be more fully understood by reference to the following example.

EXAMPLE 1

This example illustrates the process of the present invention. Set forth below are the impurities both before and after the treatment:

| Impurity | Percent by Weight Before | After |
|---|---|---|
| Silicon | 1.87 | 0.10 |
| Manganese | 0.71 | 0.19 |
| Titanium | 1.53 | 0.03 |
| Calcium | 0.51 | 0.01 |
| Chromium | 0.34 | 0.23 |
| Aluminum | 0.15 | 0.07 |
| Oxygen | 1.00 | 0.50 |
| Carbon | 0.03 | 0.10 |

In order to prepare a melt, 475 kg of an unrefined metallurgical grade ferrophosphorus, which contained about 26.5 weight percent phosphorus, and about 255 kg of scrap steel were melted together in a clay-graphite crucible in an induction furnace. After the ferrophosphorus and iron had melted, the furnace was maintained at a temperature of about 1400° C. To this melt was added 135 kg of iron oxide ($Fe_2O_3$) as an oxidizing agent. The oxidizing agent was added by means of batch additions. Treatment lasted for about 20 minutes and then the slag from the top of the melt was removed by means of decanting the slag from the alloy. The molten, refined ferrophosphorus was then solidified as a tall ingot and subsequently crushed and milled.

The refined ferrophosphorous contained 15.5 weight percent phosphorus and impurities as shown in the table above. The amounts of impurities were measured in a conventional manner.

In order to crush and mill the ingot, refined alloy was cast into tall ingots and then broken into pieces of less than about 4 inches by means of a Jaw-crusher. Next the pieces were crushed to less than about 0.5 inches with a cone-crusher. The pieces were further crushed to a size of less than about 0.025 inches by means of a hammer-mill and were finally milled in a fluidized-bed mill, under an inert atmosphere, to a top size of less than about 31 μm and a median size of about 10μm, using an in situ classifier.

It will be noted from the table above that the final carbon is greater than the initial carbon. This carbon pick-up was from the crucible. Carbon content, like iron content, can be adjusted to the ferrophosphorus in the present invention. Preferably, if additional carbon is needed in the ferrophosphorus, it is added after the treatment step. It should be noted that the carbon level hereinabove can be greater than the preferred low level of carbon, below about 0.5 weight percent.

Additionally, it has been found that a certain degree of refining, removal of impurities, is obtained by merely forming a melt of unrefined metallurgical grade ferrophosphorus at a temperature above the melting point of the alloy so as to form a slag and then removing the slag from the melt without the treatment with an oxidizing agent. However, the degree of refining in such a process is substantially less than when the melt is treated with an oxidizing agent in accordance with the present invention.

It will be understood that the claims are intended to cover all changes and modifications of the preferred embodiments of the invention herein chosen for the purpose of illustration which do not constitute a departure from the spirit and scope of the invention.

What is claimed is:

1. A method for refining and making a ferrophosphorus for use in the manufacture of particulate metal products comprising the steps of:

(a) forming a melt of ferrophosphorus from metallurgical grade ferrophosphorus having a phosphorus content of about 15 to about 30 weight percent, an iron content of about 80 to about 65 weight percent and a remainder of impurities, said impurities comprising silicon, manganese, chromium, carbon, titanium, aluminum and calcium;

(b) mixing into said melt an oxidizing agent to oxidize impurities in said melt, said oxidizing agent added to said melt in an amount equal to about the stoichiometric amount to about 200% in excess of said stoichiometric amount, said stoichiometric amount being calculated based on the amount of said impurities in said melt and the available effective-oxygen content of said oxidizing agent;

(c) maintaining the temperature of said melt at about 100° C. to about 200° C. above the melting point of said ferrophosphorus such that a slag is formed on top of the melt and oxidized impurities migrate in said melt to said slag;

(d) removing the slag from the top of the melt;

(e) recovering a solid, refined ferrophosphorus having substantially reduced impurities;

(f) solidifying said recovered ferrophosphorus to form a solid therefrom; and (g) crushing and grinding said solid ferrophosphorus in an inert atmosphere to form particulate for use in the manufacture of particulate metal products.

2. The method of claim 1 wherein the starting ferrophosphorus is a metallurgical grade ferrophosphorus having a phosphorus content of about 15 to about 30 weight percent, an iron content of about 80 to about 65 weight percent iron and the remainder being impurities.

3. The method of claim 1 wherein the oxidizing agent is selected from the group consisting of ferrous oxide, ferric oxide, ferrous-ferric oxide, mill scale, limestone, dolomitic limestone, oxygen, air, carbon dioxide, and a mixture thereof.

4. The method of claim 1 further comprising the step of adding an iron source to the melt to adjust the phosphorus content of the melt.

5. The method of claim 1 further comprising the step of adding a flux agent to the melt to flux the oxide impurities in the melt.

6. The method of claim 1 further comprising the step of adding a deoxidizing agent, with stronger oxygen affinity than silicon, to the refined molten ferrophosphorus to substantially remove any dissolved oxygen.

7. The method of claim 4 wherein the iron source is selected from the group consisting of iron scrap or steel scrap, both with low levels of impurities, and pure iron pieces.

8. The method of claim 5 wherein the flux agent or agents are selected from the group consisting of lime, limestone, dolomitic limestone, dolomite, calcium fluoride and any alkalide carbonate.

9. The method of claim 6 wherein said deoxidizing agent is aluminum.

10. The method of claim 10 wherein said refined, molten ferrophosphorus is solidified by a method selected from the group consisting of casting into an ingot or any other shape, net-shape casting, granulation, atomization and shotting.

11. The method of claim 1 wherein said crushing and grinding is achieved by using one or a combination of equipment selected from the group consisting of jaw-crushers, cone-crushers, hammer-mills, impact mills, fluidized-bed mills, vibrating ball mills, vibratory mills, ball mills, rod mills, attrition mills, high-energy mills, cold-stream impact mills, and shear mills.

12. The method of claim 1 wherein said crushing and/or grinding incorporates a size classification system to achieve effective particle size.

13. The method of claim 12 wherein said size classification system consists of a closed-loop with respect to the mill.

14. The method of claim 5 wherein the oxidizing agent is selected from the group consisting of ferrous oxide, ferric oxide, ferrous-ferric oxide, mill scale, limestone, dolomitic limestone, oxygen, air, carbon dioxide, and a mixture thereof; and the flux agent or agents are selected from the group consisting of lime, limestone, dolomitic limestone, dolomite, calcium fluoride and any alkalide carbonate.

15. The method of claim 5 further comprising the step of adding an iron source to the melt to adjust the phosphorus content of the melt, said iron being selected from the group consisting of iron scrap or steel scrap, both with low levels of impurities, and pure iron pieces.

16. The method of claim 14 further comprising the step of adding an iron source to the melt to adjust the phosphorus content of the melt, said iron being selected from the group consisting of iron scrap or steel scrap, both with low levels of impurities, and pure iron pieces.

17. The method of claim 14 further comprising the step of adding aluminum as a deoxidizing agent, with stronger oxygen affinity than silicon, to the refined molten ferrophosphorus to substantially remove any dissolved oxygen.

18. The method of claim 14 wherein said refined, molten ferrophosphorus is solidified by a method selected from the group consisting of casting into an ingot or any other shape, net-shape casting, granulation, atomization and shotting.

19. The method of claim 18 wherein said crushing and grinding is achieved by using one or a combination of equipment selected from the group consisting of jaw-crushers, cone-crushers, hammer-mills, impact mills, fluidized-bed mills, vibrating ball mills, vibratory mills, ball mills, rod mills, attrition mills, high-energy mills, cold-stream impact mills, and shear mills.

20. The method of claim 19 wherein said crushing and/or grinding incorporates a size classification system to achieve effective particle size and said size classification system consists of a closed-loop with respect to the mill.

* * * * *

UNITED STATES PATENT AND TRADEMARK OFFICE

CERTIFICATE OF CORRECTION

PATENT NO. : 5,362,440

DATED : November 8, 1994

INVENTOR(S) : Deepak Madan et al.

It is certified that error appears in the above-indentified patent and that said Letters Patent is hereby corrected as shown below:

Abstract, line 5, change "forte" to --from--.

Abstract, line 8, change "($Fe_2O_3$)" to --(FeO)--; change "($Fe_3O_4$)" to --($Fe_2O_3$)--.

Abstract, line 9, change "(FeO)" to --($Fe_3O_4$)--.

Abstract, line 10, change "alkalide carbonate" to --carbonate of an alkali metal or alkaline earth metal--.

Column 1, line 32, after "example" insert --,--.

Column 2, line 45, after "of" insert --an--.

Column 3, line 22, change "I" to --l--; line 40, change "i" to --l--.

Column 6, line 39, change "Jaw-crusher" to --jaw-crusher--.

Column 7, lines 37-41 (claim 2): cancel claim 2.

Column 7, line 51 (claim 5), after "agent" insert --or agents--

Column 8, line 2 (claim 8), change "alkalide carbonate" to --carbonate of an alkali metal or alkaline earth metal--.

UNITED STATES PATENT AND TRADEMARK OFFICE

CERTIFICATE OF CORRECTION

PATENT NO. : 5,362,440

DATED : Nov. 8, 1994

INVENTOR(S) : Deepak Madan et al.

It is certified that error appears in the above-indentified patent and that said Letters Patent is hereby corrected as shown below:

Col. 8, line 5 (claim 10), change the dependency from "claim 10" to --claim 1--.

Col. 8, line 30 (claim 14), change "alkalide carbonate" to --carbonate of an alkali metal or alkaline earth metal--.

Signed and Sealed this

Thirteenth Day of June, 1995

Bruce Lehman

*Attest:*

BRUCE LEHMAN

*Attesting Officer*

*Commissioner of Patents and Trademarks*